US006662644B1

(12) United States Patent
Grotendorst et al.

(10) Patent No.: US 6,662,644 B1
(45) Date of Patent: Dec. 16, 2003

(54) FORMATION FLUID SAMPLING AND HYDRAULIC TESTING TOOL

(75) Inventors: Josef Grotendorst, Dorstem (DE); Gerhard Grotendorst, Ferlach (AT)

(73) Assignee: EDM Systems USA, Albuquerque, NM (US)

( * ) Notice: Subject to any disclaimer, the term of this patent is extended or adjusted under 35 U.S.C. 154(b) by 0 days.

(21) Appl. No.: 10/187,302

(22) Filed: Jun. 28, 2002

(51) Int. Cl.[7] ..... E21B 47/00; G01N 1/14

(52) U.S. Cl. ..... 73/152.23; 73/152.19; 175/40; 166/264

(58) Field of Search ..... 73/152.23, 152.19, 73/152.55; 166/264; 175/40

(56) References Cited

U.S. PATENT DOCUMENTS 2,214,550 A * 9/1940 Edwards ..... 166/1
3,969,937 A * 7/1976 Barrington et al. ..... 73/152.23
3,981,189 A * 9/1976 Howard et al. ..... 73/152.23
5,054,553 A 10/1991 Grotendorst ..... 166/278
5,127,261 A * 7/1992 Ingram et al. ..... 73/84
5,520,046 A * 5/1996 Sornein et al. ..... 73/152.23

* cited by examiner

*Primary Examiner*—Hezron Williams
*Assistant Examiner*—David J. Wiggins
(74) *Attorney, Agent, or Firm*—R W Becker & Associates; R W Becker

(57) ABSTRACT

A formation fluid sampling and hydraulic testing tool for a drilling apparatus that includes a drilling string comprised of a drilling pipe and a drilling bit is provided. The tool has an outer tube disposed between the drilling pipe and the drilling bit. The outer tube is provided with a plurality of through holes for receiving formation fluid into the outer tube. An inner tube is disposed within, and spaced from, the outer tube to form an annular space between them. The inner tube is provided with a plurality of through holes that are adapted to communicate with the annular space. One end of the inner tube is connectable to a pumping mechanism for drawing formation fluid through the through holes of the outer tube and of the inner tube for the purpose of collecting a sample of the fluid and imposing a hydraulic stress on the formation. The through holes of the inner tube can be closed off or released. Valves are provided for establishing or closing off communication between the interior of the inner tube and the open ends of the outer tube.

13 Claims, 2 Drawing Sheets

FORMATION FLUID SAMPLING AND HYDRAULIC TESTING TOOL

BACKGROUND OF THE INVENTION

The present invention relates to a formation fluid sampling and hydraulic testing tool for a drilling apparatus that includes a drilling string comprised of a drilling pipe and a drilling bit. The present invention further relates to a method of drilling and sampling with such a drilling apparatus.

Formerly, to obtain a valid formation fluid sample from single or multiple rock units within the earth, it was necessary to drill a borehole to the total depth, to run down-the-hole geophysical logs, to set casing cemented to the surface, to run a wireline shot-tool into the cased hole to a desired sampling location, to shoot holes through the casing and the cement-filled annular space behind the casing and into the formation, such that formation fluid can enter the interior of the casing, to set a straddle-packer across the shot zone, to insert a pumping device and pump the fluid out until its pH and electrical conductivity stabilize. The procedure of shooting the casing and setting a packer is repeated for as many formations as desired. If hydraulic testing is desired, a pressure transducer must be set between the upper and lower packers of the straddle packer and an electrical line must be run to the surface. These processes are costly and time consuming.

The former method has the further disadvantage that cracking of the cement in the annular space between the boreface and the steel casing can form a pathway for flow of formation fluids behind the casing resulting in possible cross-contamination and alteration of formation fluid pressures.

Alternatively side wall sampling devices try to extract fluid samples from a formation behind the mud cake on the boreface. Such samples are usually contaminated by drilling fluid, and the criterion of pumping until constant pH and electrical conductivity are achieved cannot be obtained.

One effort for improving the aforementioned procedures was described in U.S. Pat. No. 5,054,533. However, this effort does not provide the desired time and cost savings.

It is therefore an object of the present invention to provide a formation fluid sampling and hydraulic testing tool that significantly reduces the time and cost involved in the acquisition of samples of fluids contained within subsurface rock strata without removing the drilling tools from a borehole. Such a tool should also allow the determination of hydraulic characteristics of these same subsurface rock strata, again without removing the drilling tools from the borehole, and should prevent possible cross contamination and/or alteration of fluid pressures and provide better information for design of any well completions.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
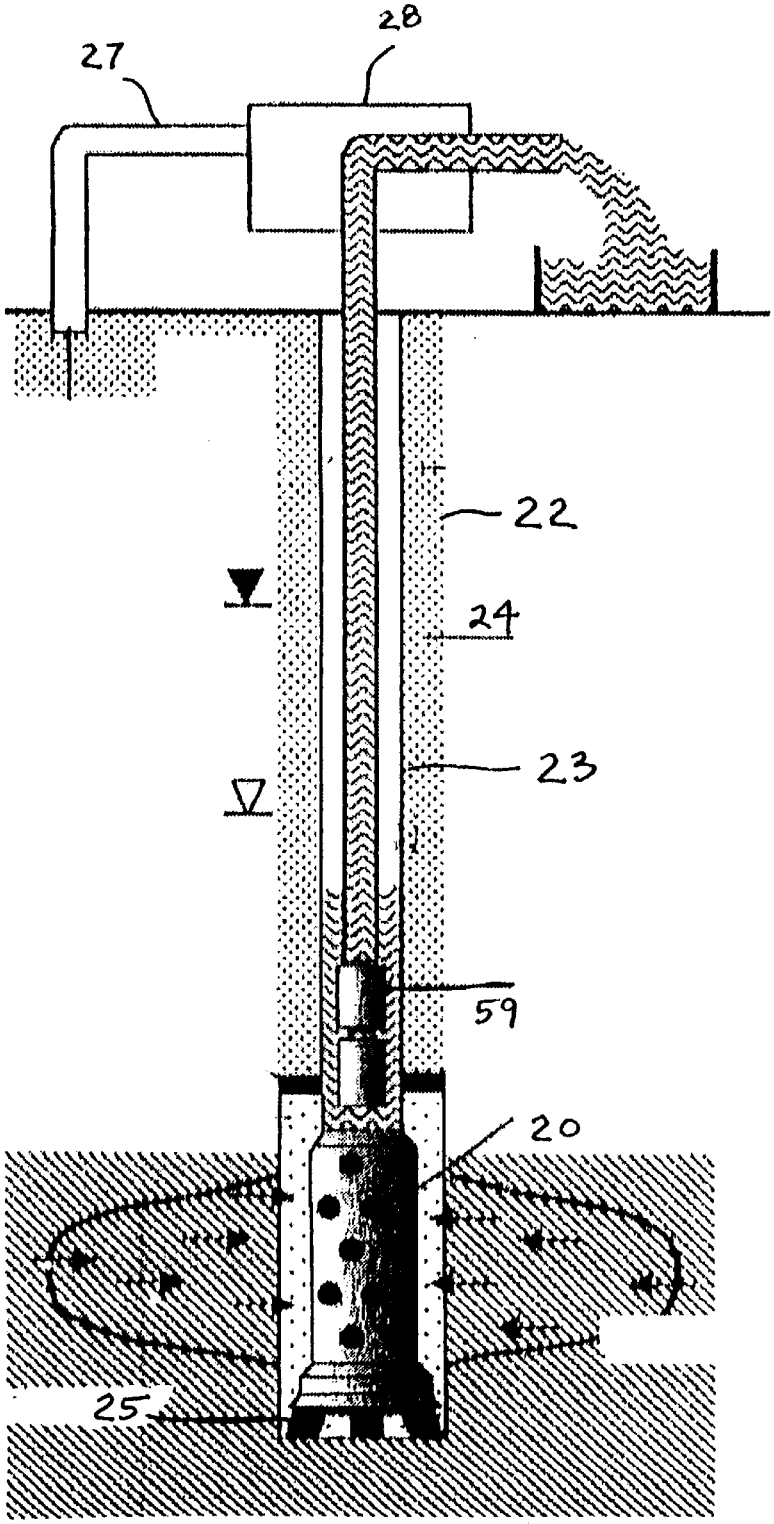
FIG. 1 illustrates a drilling apparatus setup that is provided with one exemplary embodiment of the inventive formation fluid sampling and hydraulic testing tool.

The formation fluid sampling and hydraulic testing tool of the present invention is characterized primarily by: an outer tube that is disposed between the drilling pipe and the drilling bit, with the outer tube being provided with a plurality of through holes for receiving a sample of formation fluid into the outer tube; an inner tube that is disposed within, and spaced from, the outer tube to form an annular space between them, with the inner tube being provided with a plurality of through holes disposed at one end of the inner tube and adapted to communicate with the annular space, wherein such end of the inner tube is connectable to a pumping mechanism for drawing a sample of formation fluid through the through holes of the outer tube and the through holes of the inner tube; means for closing off or releasing the through holes of the inner tube; means for sealing the annular space from the open ends of the outer tube; and first and second valve means for establishing or closing off communication between the interior of the inner tube and the open ends of the outer tube.

As indicated above, pursuant to the present invention the formation fluid sampling and hydraulic testing tool is disposed between the drilling pipe and the drilling bit. The inventive tool acts as a piece of drill pipe when drilling and passes the drilling fluid to the drilling bit for lubricating the latter and removing formation cuttings from a borehole while drilling and for conditioning the borehole. When a fluid sample is desired, drilling is terminated at the desired depth. A pumping mechanism is emplaced in the drilling pipe and drilling fluid is pumped out of the drilling pipe. The pressure differential between the interior and exterior of the drilling string caused by the difference in fluid level inside and outside the drilling pipe and the tool actuates a plurality of valves and flaps within the inventive tool, which opens the through holes in the wall of the inner tube of the tool, allowing formation fluid to enter the tool and to be extracted by the pumping device. As with past methods, the sample is collected when the pH and the electrical conductivity stabilize.

To obtain hydraulic information of the formation, a pressure transducer or other pressure sensing device is simply lowered inside the drilling pipe. Drawdown and recovery pressure data can be easily obtained for determining undamaged aquifer transmissivity and/or a formation mobility ratio.

When sampling and testing are completed, the drilling pipe is filled with drilling fluid and is overpressured. The overpressure causes reversal of the actuation of the valves and flaps, and drilling resumes until the next point of sampling and hydraulic testing. If a geophysical log is desired, it is obtained following completion of drilling.

From the foregoing, it can be seen that in contrast to heretofore known apparatus, the inventive formation fluid sampling and hydraulic testing tool eliminates the expense of casing the borehole and cementing it in place. Furthermore, the inventive tool eliminates the wire-line shot perforation process and the necessity for repeatedly emplacing and removing the straddle packer. The inventive tool also eliminates the possibility of cross-contamination between different zones in a perforated well caused by pressure differentials between the various fluid-filled rock formations in the subsurface.

Further specific features of the present invention will be described in detail subsequently.

DESCRIPTION OF PREFERRED EMBODIMENTS

Figure 2:
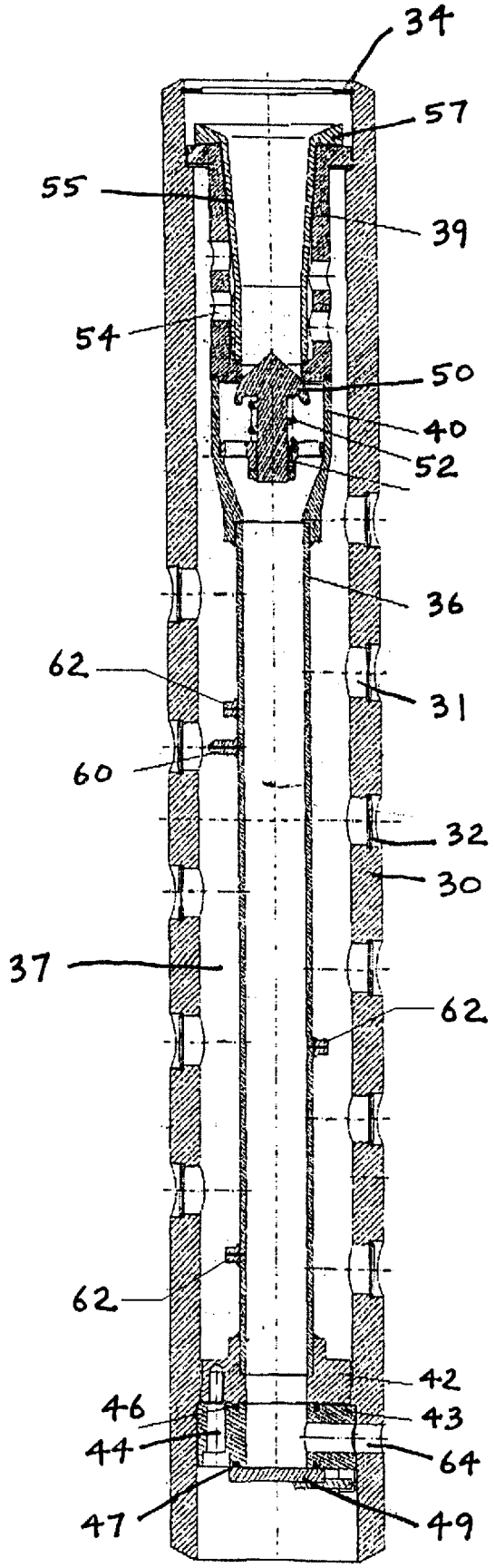
FIG. 2 is a detailed view of one exemplary embodiment of the inventive formation fluid sampling and hydraulic testing tool.

Referring now to the drawings in detail, FIG. 1 illustrates a drilling apparatus that is provided with the inventive formation fluid sampling and hydraulic testing tool, which is generally indicated by the reference 20. In particular, FIG. 1 schematically shows a drilling site, including a borehole 22 in which is disposed the drilling string, comprised of a drilling pipe 23 and stabilizers. An annular space 24 exists between the wall of the borehole 22 and the drilling pipe 23, and is appropriately stabilized, for example by the drilling fluid. For a mud-rotary or oilbased fluid-drilling operation, a drilling bit 25 is attached to the lower end of the apparatus, with the inventive sampling and testing tool 20 being disposed between the drilling string and the drilling bit 25. The inventive tool is shown in detail in FIG. 2 and will be described in detail subsequently.

The annular space of the borehole 22 around the inventive sampling and testing tool 20, and slightly thereabove, is filled with drill cuttings of the material that has been drilled, which acts as a filter medium. During a drilling operation, drilling fluid is circulated through the system by being pumped from the surface, for example via the conduit or suction line 27 and the pump or unit 28, into the drilling string, through the inventive sampling and testing tool 20, and then to the bit 25. The drilling fluid subsequently enters the annular space 24 and rises to the surface, where it is recirculated and pumped back into the drilling string.

The sampling and testing tool 20 of the present invention includes an outer tube 30 that is provided with a plurality of through holes 31 through the wall of the tool. In one specific embodiment of the present invention, a total of fifty-five through holes 31 are provided. In particular, eleven rows of such holes, with each row being provided with five through holes 31, are provided. Filters 32, for example made of stainless steel screen, are disposed in each of the holes 31. A sealing ring 34 or the like is disposed at the upper end of the outer tube 30 to provide a seal between the tool 20 and the drilling string or pipe 23 thereof.

Disposed in the apertured outer tube 30 is an inner tube 36 that is spaced from the outer tube to form an annular space 37 between them. Appropriate means are provided for sealing the annular space 37 from the open ends of the outer tube 30.

In particular, such sealing means includes a flanged sleeve 39 and a valve housing 40 that adjoin one another and extend from the upper end of the inner tube 36 to near the open upper end of the outer tube 30. At the opposite, lower end of the inner tube 36, there are provided flange means 42, 43 that are disposed on the outer tube 30 and the inner tube 36 respectively and are interconnected with one another, for example via appropriate screws 44. In addition, a sealing means, such as an O-ring 46, can be provided between the two flange means 42 and 43. A further sealing means, such as the O-ring 47, can be disposed between the flange means 43 and a lower valve flap 49 that either closes off the lower end of the inner tube 36, or allows communication between the interior of the inner tube 36 and the lower open end of the outer tube 30.

Similarly, the upper end of the inner tube 36 can either be closed off or open for communication with the upper end of the outer tube 30. In particular, a valve means in the form of a valve cone 50 is biased by the spring 52 against the flanged sleeve 39. The valve cone 50 is supported in the valve housing 40. In addition, the flanged sleeve 39 is provided with a plurality of through holes 54 that are open to the annular space 37. Communication between the annular space 37 and the open upper end of the outer tube 30 is made possible by these through holes 54. In addition, such communication can be blocked by means of the sleeve 55, which is embodied as a conical sleeve and is provided with flanges 57 that rest upon the flanged sleeve 39.

A very critical feature and distinct advantage of the inventive sampling and testing tool 20 is that the tool no longer has an inner filling of gravel or the like. Such a filling, with its inherent drawbacks, is of course undesirable, and the need therefor has been completely obviated with the inventive tool.

The drilling apparatus, and in particular the inventive sampling and testing tool 20, operate as follows. For a normal drilling operation, as mentioned above, drilling fluid is pumped into the drilling pipe 23. In so doing, the drilling fluid enters the upper open end of the outer tube 30, and presses the valve cone 50 downwardly. Because the drilling fluid is at a pressure of, for example, 25 bar, it easily opens the valve cone 50, which is biased with a pressure of only, for example, 2–3 bar. The drilling fluid then passes through the inner tube 36, and presses against the, for example spring-loaded, lower valve flap 49, which is biased in a closed position at 4–5 bar. The drilling fluid then passes through the open lower end of the outer tube 30, and drives the drilling bit 25. Subsequently, the drilling fluid passes up the annular space through the gravel or other suitable fill around the tool 20, and enters the annular space 24.

It should be noted that during such normal drilling operation, the sleeve 55, which is pressed down by the pressure of the drilling fluid, securely closes off the through holes 54.

To now obtain a sample at the level of the sampling and testing tool 20, the flow of drilling fluid is halted. As a result, the lower valve flap 49 as well as the valve cone 50 close. A pumping mechanism 59 (FIG. 1) is submerged into the drilling pipe 23 and some of the drilling fluid that is in the drilling pipe is pumped out. This results in an underpressure, as a consequence of which the sleeve 55 is raised, thereby freeing and exposing the through holes 54. Thus, a formation fluid that is to be sampled, such as, by way of example only, water, oil, gas, or other mineral-containing fluid, can now enter the annular space 37 through the through holes 31 in the outer tube 30. The formation fluid then passes through the through holes 54 and can be pumped out of the open upper end of the outer tube 30 to a collecting site on the surface.

Normal drilling operation can now be immediately resumed. To do so, the submerged pumping mechanism 59 is removed or otherwise brought out of the drilling pipe 23. Drilling fluid is again pumped into the drilling pipe 23, thereby pushing the sleeve 55 down and tightly against the through holes 54. The valve cone 50 and the lower valve flap 49 are again opened due to the pressure of the drilling fluid, and the drilling string and bit 25 are rotated and drilling is resumed.

The sampling and testing tool 20 is furthermore provided with a plurality of nozzles 60, one at each of the through holes 31, which operate continuously during a drilling operation. In particular, the nozzles 60 are directed against the filters 32 to clean them by rinsing filter cake, which consists of the drilled material and solids in the drilling fluid, from these filters so that the through holes 31 are kept open. To simplify illustration of FIG. 2, only one such nozzle 60 has been shown.

A further advantage of the inventive sampling and testing tool 20 is that, in contrast to the heretofore known methods, where a gravel filter had to be artificially placed, it is now possible with the inventive tool to form the required external gravel filter by means of formation cuttings generated by the drilling bit 25. Fine cuttings generated during drilling settle back onto the coarser cuttings around the inventive tool when drilling stops, and can be pumped out by the pumping mechanism 59 when drilling resumes. This creates a viable, coarse gravel filter around the inventive tool, and makes it easy to blow out the filters 32 of the through holes 31 when drilling is resumed.

It is also to be understood that the inventive sampling and testing tool 20 can be provided in multiple sections in order to have a tool of the desired length.

As indicated above, the valve cone 50 should be closed during a sampling operation in order to prevent sediment from contaminating the sampling. However, if for some reason the valve cone 50 does not close properly, and sediment enters the inner tube 36, thereby closing it off for further use, due to the thickness of the sediment, the increasing pressure from the drilling fluid will open safety valves 62 that are spaced along the inner tube and are directed into the annular space 37. In the illustrated embodiment, three such safety valves 62 are provided. Such safety valves open at, for example, a pressure of 25 bar, and again rinse off the outer filter cakes of drilling material that is on the filters 32. A drilling operation can then proceed normally.

With regard to the lower valve flap 49, this valve, which is moveably mounted to either the outer tube 30 or the inner tube 36, for example via one of the flanges 42 or 43, is biased at a greater pressure than is the valve 50 as a further safety measure.

In the event that the drilling bit 25 is not operating, for example because the lower valve flap 49 cannot open, further safety measures in the form of valves 64 are provided at the lower end of the inventive tool 20. For example, three such valves 64 can be provided. These valves operate as follows, and are biased, for example, at 25 bar. If, for example, the lower valve flap 49 will not open, the pressure of the drilling fluid increases until the valves 64 are opened. These valves then effect a rinsing-off of the filter cake from the outside of the valve flap 49 so that it can again open and the drilling operation can resume.

Most of the components of the inventive sampling and testing tool 20, with the exception of the O-rings, are made of stainless steel, such as the steel having the designation V 4*a*, which is prescribed by DIN1.45.71. On the other hand, the conical sleeve 55 is preferably made of aluminum.

The present invention is, of course, in no way restricted to the specific disclosure of the specification and drawings, but also encompasses any modifications within the scope of the appended claims.

What we claim is:

1. A formation fluid sampling and hydraulic testing tool for a drilling apparatus that includes a drilling string comprised of a drilling pipe and a drilling bit, said tool comprising:

an outer tube disposed between said drilling pipe and said drilling bit, wherein said outer tube is provided with a plurality of through holes for receiving a sample of formation fluid into said outer tube, and wherein opposite ends of said outer tube are open;

an inner tube disposed within, and spaced from, said outer tube to form an annular space between them, wherein said inner tube is provided with a plurality of through holes disposed at one end of said inner tube and adapted to communicate with said annular space, and wherein said one end of said inner tube is connectable to a pumping mechanism for drawing a sample of formation fluid through said through holes of said outer tube and said through holes of said inner tube;

means for closing off or releasing said through holes of said inner tube;

means for sealing said annular space from said open ends of said outer tube; and first and second valve means for establishing or closing off communication between an interior of said inner tube and said open ends of said outer tube.

2. A tool according to claim 1, wherein said means for sealing said annular space includes a sleeve disposed at said one end of said inner tube, and wherein said through holes of said inner tube are disposed in said sleeve.

3. A tool according to claim 2, wherein said first valve means is mounted in said sleeve and is spring loaded in a closing position.

4. A tool according to claim 3, wherein said means for closing off or releasing said through holes of said inner tube is a sleeve disposed in said sleeve that is disposed at said one end of said inner tube, wherein said sleeve for closing off or releasing said through holes is adapted to cover said through holes.

5. A tool according to claim 1, wherein said second valve means is disposed at another end of said inner tube.

6. A tool according to claim 5, wherein at least one valve is provided in the vicinity of said second valve means for cleaning said second valve means.

7. A tool according to claim 1, wherein a plurality of nozzles are disposed in said annular space, and wherein a respective one of said nozzles is associated with each of said through holes of said outer tube.

8. A tool according to claim 7, wherein each of said through holes of said outer tube is provided with a filter, and wherein said nozzles are mounted on said inner tube and are directed at said filters.

9. A tool according to claim 1, wherein safety valves are disposed on said inner tube, wherein said safety valves are adapted to respond to pressure within said inner tube, and wherein said safety valves are directed into said annular space.

10. A method of drilling and sampling with a drilling apparatus that includes a drilling string comprised of a drilling pipe and a drilling bit, said method including the steps of:

providing a formation fluid sampling and hydraulic testing tool that includes: an outer tube disposed between said drilling pipe and said drilling bit, wherein said outer tube is provided with a plurality of through holes for receiving formation fluid into said outer tube for the purpose of collecting a sample of the fluid and imposing a hydraulic stress on a formation, and wherein opposite ends of said outer tube are open; an inner tube disposed within, and spaced from, said outer tube to form an annular space between them, wherein said inner tube is provided with a plurality of through holes disposed at one end of said inner tube and adapted to communicate with said annular space; means for closing off or releasing said through holes of said inner tube; means for sealing said annular space from said open ends of said outer tube; and first and second valve means for establishing or closing off communication between an interior of said inner tube and said open ends of said outer tube;

for a drilling operation, conveying drilling fluid through said inner tube to said drilling bit for lubricating the latter and removing formation cuttings from a borehole while drilling and for conditioning said borehole, wherein said drilling fluid causes said means for closing off or releasing said through holes of said inner tube to close off such through holes, and further causes said first and second valve means to open; and for a sampling operation, terminating said drilling operation, wherein said first and second valve means close, whereupon drilling fluid is pumped out of said drilling string via said pumping mechanism to create an underpressure and cause said means for closing off or releasing said through holes of said inner tube to release such through holes, thereby allowing formation fluid to be drawn through said through holes of said outer tube into said annular space, through said through holes of said inner tube and into the interior of said inner tube, and from there into said drilling pipe and to a fluid sampling collection site.

11. A method according to claim 10, which includes the further step of directing a fluid spray from within said annular space against said through holes of said outer tube.

12. A method according to claim 10, which includes the further steps of terminating said sampling operation and reinstituting said drilling operation.

13. A method according to claim 10, which includes the further step of emplacing a pressure sensing device within said drilling string and below a pumping fluid level for the purpose of conducting aquifer performance tests or drill stem tests for determining undamaged aquifer transmissivity or a formation permeability and mobility ratio.

* * * * *